United States Patent [19]

Shih-Chen

[11] Patent Number: 4,733,759

[45] Date of Patent: Mar. 29, 1988

[54] EXPANDABLE LUGGAGE CASE

[76] Inventor: Liu Shih-Chen, No. 133-135, Sec. 5, Chung-Hwa Market, Taipei, Taiwan

[21] Appl. No.: 21,351

[22] Filed: Mar. 3, 1987

[51] Int. Cl.[4] ..... A45C 7/00

[52] U.S. Cl. ..... 190/18 A; 190/103; 383/2; D3/71; D3/76

[58] Field of Search ..... 190/903, 18 A, 103–105, 190/120; 383/2

[56] References Cited

U.S. PATENT DOCUMENTS

| | | | |
|---|---|---|---|
| 1,680,652 | 8/1928 | Walinsky | 190/120 X |
| 2,183,121 | 12/1939 | Levine | 190/903 X |
| 2,699,848 | 1/1955 | Kaplan | 190/105 |
| 2,985,265 | 5/1961 | Gehrie | 190/903 X |
| 3,141,536 | 7/1964 | Fulton | 190/903 X |
| 3,443,671 | 5/1969 | Dyke | 190/103 |
| 4,153,146 | 5/1979 | Patton et al. | 190/903 |
| 4,361,215 | 11/1982 | Sawai | 190/103 |

FOREIGN PATENT DOCUMENTS

| | | | |
|---|---|---|---|
| 2844796 | 4/1980 | Fed. Rep. of Germany | 190/103 |
| 2565796 | 12/1985 | France | 190/103 |
| 585846 | 2/1947 | United Kingdom | 190/103 |
| 2018580 | 10/1979 | United Kingdom | 190/103 |
| 2080220 | 2/1982 | United Kingdom | 190/103 |
| 2173393 | 10/1986 | United Kingdom | 190/103 |

*Primary Examiner*—William Price
*Attorney, Agent, or Firm*—Leonard Bloom

[57] ABSTRACT

An adjustable size soft body luggage case is provided with a lid that is capable of pivoting outwardly of the remainder of the case, whereby access to the entire interior storage space is provided. The body of the case includes side walls, end wall, a top wall and a lower periphery. An access opening formed between one of the end walls and the top, bottom and at least one of the side walls, whereby a lid is defined. At least one collapsable gusset having side and end walls is secured to the lower periphery of the body. Each gusset has a fastener assembly means including a slider and a pair of fastener elements having a base end and a distal end. One of the pair of fastener elements is secured to the upper periphery of a respective gusset. The other of the pair of fastener elements is secured to the lower periphery of the same respective gusset. The slider has a male connector element secured thereto. A female connector element is secured to the lid portion of each gusset. The base end of the fastener elements are positioned on a bridging flap. The distal ends of the fastener elements are disposed on the lid beyond the female connector. When the female and male connectors are coupled to one another, the bridging flap extends over the access opening.

6 Claims, 9 Drawing Figures

EXPANDABLE LUGGAGE CASE

FIELD OF INVENTION

The present invention relates to expandable luggage cases and, in particular, to expandable luggage cases having a soft body which provides unrestricted access to the internal storage space thereof.

BACKGROUND OF THE INVENTION

Generally, soft luggage cases of which I am aware are equipped with openings providing access to the internal (interior) storage space thereof, so that articles may either be placed therein or removed therefrom. Such cases have a fixed quantity of internal storage space for holding articles, such as clothing. Opening and closing of these openings is usually provided for by a zipper formed about this opening.

Soft luggage cases of the above-mentioned variety are particularly disadvantageous in that, especially if the fixed quantity of internal (interior) storage space provided is not completely filled, shifting of the articles carried therein is likely to occur, which is undesirable, or worse, damaging thereto. Such cases are further disadvantageous in that the length of the zipper limits the size of the opening to the interior storage space. This condition is problematic when larger sized articles need to be placed therein. Preferably, this zipper (and the access opening) should extend over at least three of the sides of the case, so that when unzipped along its entire length, the lid of the bag may be pivoted outwardly at least substantially 180° from the remainder of the case. Additionally, when top loading bags, such as that of the variety illustrated in FIG. 1 are involved, it is difficult to remove articles from the bottom of the case without disturbing the articles positioned thereabove.

In an attempt to alleviate the disadvantages mentioned above, a luggage case having an adjustable size has been proposed having vertically spaced webbing secured to the entire periphery of the lower end of the case. Each webbing is fitted with a respective zipper which, when the webbing is collapsed, may be zipped reducing the size of the container, and which, when unzipped, allows the size of the container to be increased. In this manner, the size of the luggage case may be adjusted as necessary to avoid the trouble of the interior storage space being either too large or too small. However, the length of the access opening (and the zipper) of such luggage does not extend over a length of at least three of the sides of the case. Accordingly, such cases still have the disadvantages associated with having a limited opening to access the interior storage space.

Therefore, it can be seen that there remains a need to provide a soft body luggage case which zips open, so that the lid may be pivoted outwardly substantially 180 degrees from the remainder of the case and which is adjustable in size.

SUMMARY OF THE INVENTION

Accordingly, it is the primary object of the present invention to provide a soft body luggage case which is expanded, so that the size of the interior space may be selectively adjusted, and in which the lid may be pivoted outwardly substantially 180 degrees from the remainder of the case.

It is another object of the present invention to provide a new style of luggage case having a top cover which is able to be lifted off or closed.

Another object of this invention provides a new style of luggage case having a body which can be adjusted in size.

Still another object of this invention is to provide a new style of luggage case in which the top cover can be lifted off or pivoted, regardless as to whether the case is closed, or fully or partially extended.

In accordance with the teachings of the present invention, an adjustable size luggage case is disclosed. The case has a substantially rectangular body. The body has end walls, side walls and a top wall which extends between the end walls and the side walls. A lower periphery is defined extending about the side walls and end walls opposite the top wall. The side walls, end walls and top wall defines an interior storage space therebetween. At least one gusset is secured to and extends around the lower periphery, such that a lowermost gusset is provided. Each of said gussets has respective side walls, end walls, an upper periphery and a lower opposite periphery. Each of said respective gussets further has a first collapsed position, wherein the gusset is closed and a second, expanded position, wherein the gusset is opened. A bottom wall extends between the end walls of the lowermost gusset and further extends between the side walls of the lowermost gusset, at least the top wall, the bottom wall and at least one of the side walls of the body and the gusset having a single continuous access opening formed therein. In this fashion, at least one of the side walls may be pivoted outwardly substantially at least 180 degrees from the remainder of the body, whereby access to the interior storage space is provided. An access opening zipper means is formed about the access opening for selective opening and closing of the access opening. A fastener assembly means is positioned on each of the gussets. Each of these fastener assembly means having a respective slider and a pair of fastener elements includes a base end and a distal end. One of the pair of fastener elements is connected to the upper periphery of each gusset. The other of the pair of each fastener elements is connected to the lower opposite periphery of each gusset. A bridging flap is positioned on each of the gussets. The bridging flap has one end which is integrally secured to one of the side or end walls of the said gusset. The bridging flap further has a second opposite end. A male connector element is secured to each respective slider. A female connector element is secured to another of the said side walls or end walls of the gusset which is separated from the said one of the side or end walls of the gusset by the access opening. The female connector element removably receives and secures the male connector element therein. In this fashion, the male and female connector elements are removably secured to each other. The base end of each fastener element is positioned on a respective bridging flap. The distal end of each fastener element is disposed on the said another of said side walls or end walls of the gussets, said distal ends extending beyond the female connector. Movement of the pull tab along the fastener elements selectively fasten the pair of fastener elements of each respective fastener assembly means to the other fastener element of the same pair. This movement of the pull tab moves the gusset into its first collapsed position and further selectively unfastens one of the fastener elements of each respective fastener assembly means from the other fastener element of the same pair, moving the gusset into its second, expanded position. When the male and female connector elements are connected to one another, the bridging flap extends over the access opening and the second opposite end of the flap is removably secured to the other of said side or end walls of the respective gussets.

These and other advantages of the present invention will become apparent by reference to the drawings and the following description thereof.

DESCRIPTION OF THE PREFERRED EMBODIMENTS

Figure 1:
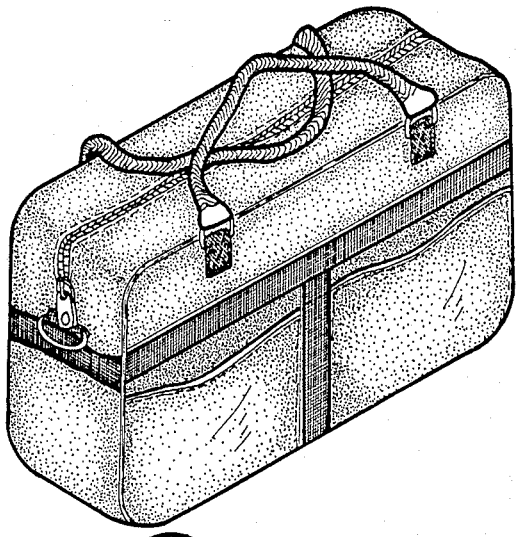
FIG-1 prior art
FIG. 1 is a conventional soft luggage case of the prior art having a fixed quantity of interior storage space for holding articles.
Figure 2:
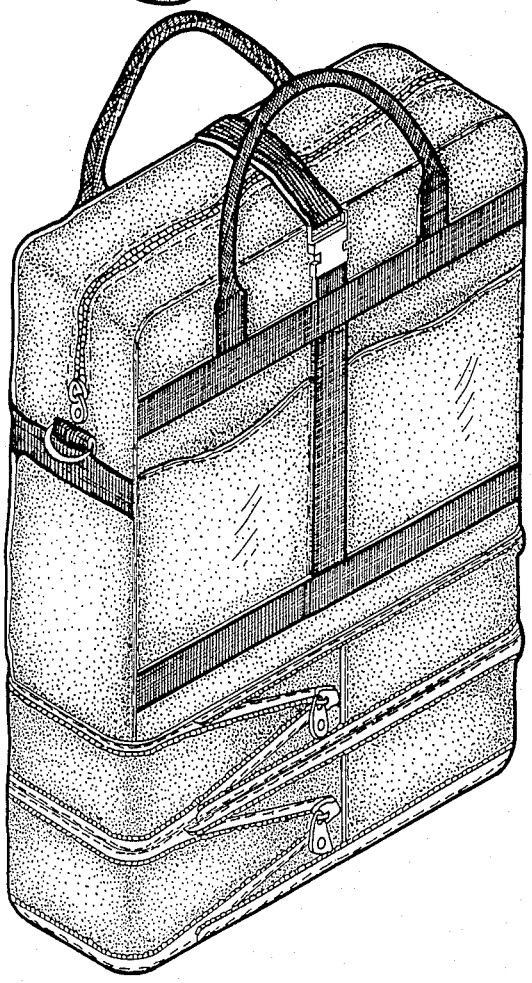
FIG-2 prior art
FIG. 2 is another conventional soft luggage case of the prior art which may be adjusted to vary the quantity of interior storage space provided for holding articles.
Figure 3:
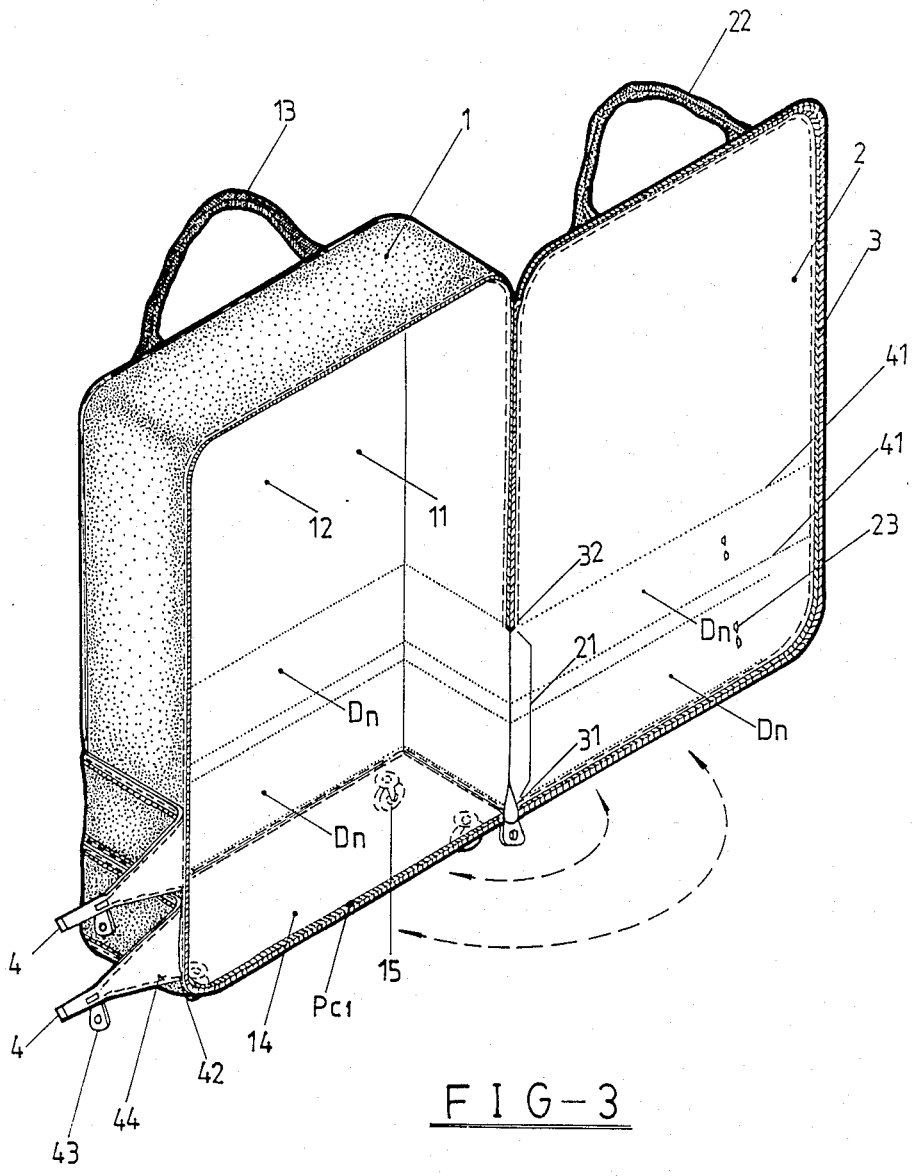
FIG. 3 is a perspective view of one embodiment of the soft luggage case of the present invention, wherein the lid thereof is pivoted outwardly substantially 180 degrees from the remainder of the case to completely reveal the interior storage space thereof.

With reference to FIGS. 1 and 2, there are illustrated prior art (conventional) soft luggage cases which respectively have a fixed quantity of internal storage space for holding articles (FIG. 1) and has an adjustable quantity of internal storage space having a limited access opening therein (FIG. 2).

With reference now to FIGS. 3–9, the adjustable size luggage case includes a preferably substantially rectangular (or square) body having side walls and end walls. End walls include a lid (top cover) 2 and a closed end surface 12, at least one gusset (surrounding body zipper) and a bottom wall (base seat) 14 which extends between the end walls of the lowermost gusset.

A single continuous access opening is formed in the top wall, bottom wall, the gussets and at least one of the side walls. As illustrated, it is preferred that the access opening further be extended in at least a portion of the other side wall. Preferably, this access opening is formed at the peripheral edge where the aforementioned walls meet the lid 2. Preferably, only the peripheral edge of the right hand lower portion of the lid 2 (where the gussets 4 are located) is secured to the body 1 by suitable means such as stitching. The remaining portion of the peripheral edge of the lid 2 between the top, bottom, and side walls is secured thereto by an access opening zipper means (top cover zipper) which is formed about the access opening for selective opening and closing of the access opening. The side walls and top wall all define (constitute) an interior storage space (enclosed empty volume) therebetween where articles, such as clothing, can be stored.

As shown in FIGS. 3–9, both the first and second embodiments of the luggage case (box) include a body 1 (and 1A) having a substantially rectangular shape (a long shape). When the lid 2 (and 2A) is pivoted outwardly from the remainder of the body 1 and 1A, complete access to the entire interior storage space is provided through opening 11 and 11A. A handle 13 and 13A is mounted on the exterior (top side) of outer wall (top wall) of the other end wall (closed end surface) 12, which is positioned opposed to the access opening 11 and 11A. At the exterior surface (bottom end) of body 1 and 1A is bottom wall (base seat) 14 and 14A which is comprised of a double layer of thicker material. Secured under the bottom wall 14 and 14A is a plurality, and preferably four, conventional casters (base wheels) 15 and 15A.

A lid (or one of said side walls-top cover) 2 and 2A is, preferably, a thin flat piece. Its size, preferably, is substantially equal to the size of the other of said side walls (closed end surface of body) 12 and 12A. Part of the lid's peripheral edge is stitched to the portion of one of the sidewalls of the body to form a stitched joint portion with the body about which the lid may pivot outwardly of the remainder of the body at least substantially 180°. A handle 22 and 22A is secured to the top of the lid (top cover) 12 and 12A. At a suitable location on an end wall of each gusset, there are female connector elements (female fasteners) 23 and 23A for fastening purposes that shall be hereinafter discussed. The number of female connector elements 23 and 23A utilized depends upon and equals the number of gussets.

Access opening zipper means is formed about the access opening being fitted between the lid and the remainder of the body. The zipper may be of the single head or double head type. It runs from base end (starting point) 31 and 31A situated at bottom of stitched joint portion 21 and 21A, then along the peripheral edges between the lid and the remainder cf the body, ceasing at distal end (final point) 32 and 32A situated at the top of the stitched joint portion 21 and 21A.

Gussets are fitted, secured to, and extend around the lower periphery within the area of stitched joint portion 21 and 21A (i.e. situated between base end 31 and 31A and distal end 32 and 32A). A plurality of gussets and, as shown in FIGS. 3–9 two such gussets, are preferred. The gussets each include a respective fastener assembly means. Each of said assembly means has a pair of fastener elements (which preferably are meshing zipper teeth) which includes a distal end (starting point) 41 and 41A (preferably positioned on the left side of the peripheral edge of the lid), then parallel about the stitched joint portion 21 and 21A. The fastener elements are connected to the upper periphery of the gusset, and the other of the pair of fastener elements are connected to the lower periphery of each gusset, until they stop at gradually contracted point 42 and 42A (see FIG. 5) located on the left side of the access opening. The portions of the fastener elements from gradually contracted point 42 and 42A extends inwardly towards one another until they join at the base end, wherein the slider (zipper head) 43 and 43A is located when the gusset is expanded. This base end is positioned on a bridging flap (suspended free end) 44 and 44A. Each bridging flap is positioned on a respective gusset having one end integral with the wall of the gusset and further having a second opposite free end. On the slider 43 and 43A is secured a male connector element (male fastener) 45 and 45A. The number of male connector elements 45 and 45A depends upon the number of gussets. As mentioned above, each of said gussets is parallel and separately fitted around the lower periphery, and the fastener elements are secured to respective upper and lower peripheries of each gusset. Therefore, there is little interval distance Dn and Dnl between the one and the other of each pair of fastener elements, which preferably are in the form of zipper teeth. The gusset between the fastener elements is folded inwardly when the slider is moved from the base end to the distal end, whereby the gusset is moved into its first collapsed position. The gusset between the fastener elements is folded outwardly when the slider is moved from the distal end to the base end, whereby the gusset is moved into its second expanded position. The bridging flap extends over the access opening and the second opposite end of the flap which carries a male connector element thereon is removably secured to the female connector element by the male connector element. Hence, the access opening zipper means can pass under the fastener assembly means of each gusset by virtue of the bridging flap so that the device may provide an access opening which pivots to provide complete access to the entire interior space.

Figure 4:
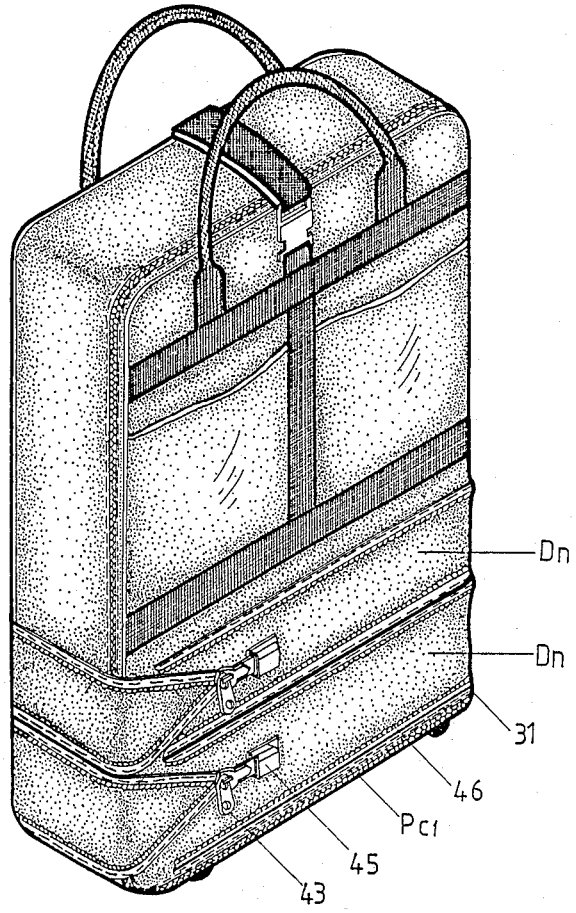
FIG. 4 is a perspective view of the case corresponding substantially to FIG. 3, wherein the lid thereof is closed.
Figure 5:
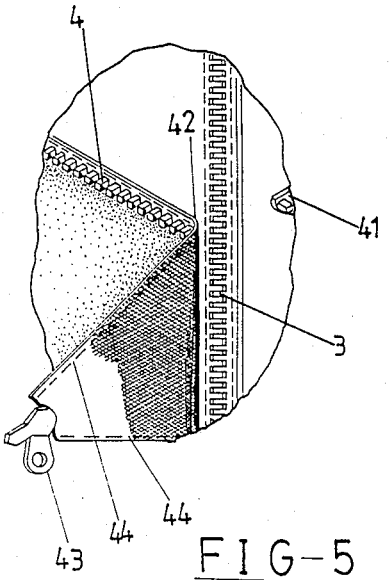
FIG. 5 is a view of a portion of the case of FIG. 4 showing, in an enlarged scale, how the bridging flap "bridges" the access opening.
Figure 8:
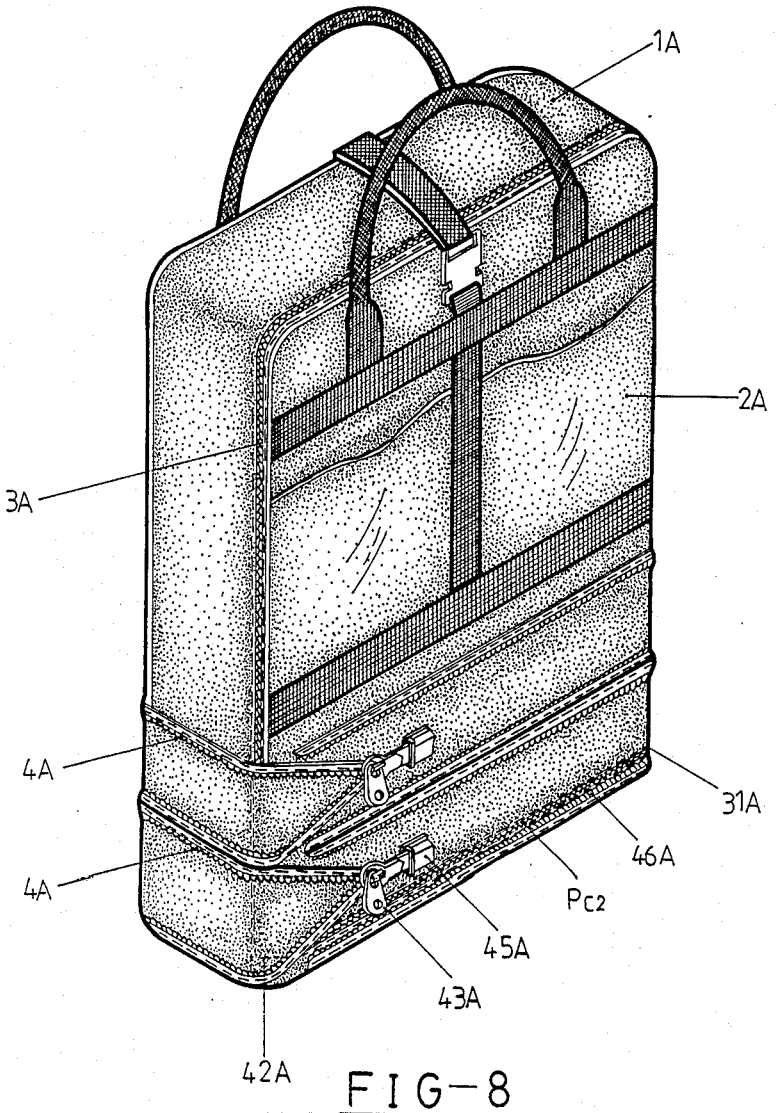
FIG. 8 is a perspective view corresponding substantially to FIG. 7, wherein the lid thereof is closed.

In this invention, the biggest difference of the second embodiment as compared with the first embodiment relates to the position of the access opening relative to the other of the pair of fastener elements which is connected to the lower opposite periphery of said gusset. As shown in FIGS. 4 and 8, said access opening has a starting portion Pc1 and Pc2, respectively, which is roughly equivalent to the distal end thereof. The starting portion Pc1 of the first embodiment is fitted at the bottom of the fastener between the lower periphery of the gusset and the other of the pair of fastener elements. Hence, when fastener assembly means is closed, the starting portion PC1 is exposed outside (See FIG. 6). The starting position PC2 of the second embodiment is fitted at the bottom of the fastener between the upper periphery of the gusset and the one of the pair of fastener elements. Relatively, the longitudinal length of lid 2A will also contract somewhat. Hence, body 1A and lid 2A can still be closed when the gussets are in their first fully collapsed position. But the starting portion PC2 is folded into the box and is cancelled when the assembly means is closed (See FIG. 9).

Figure 6:
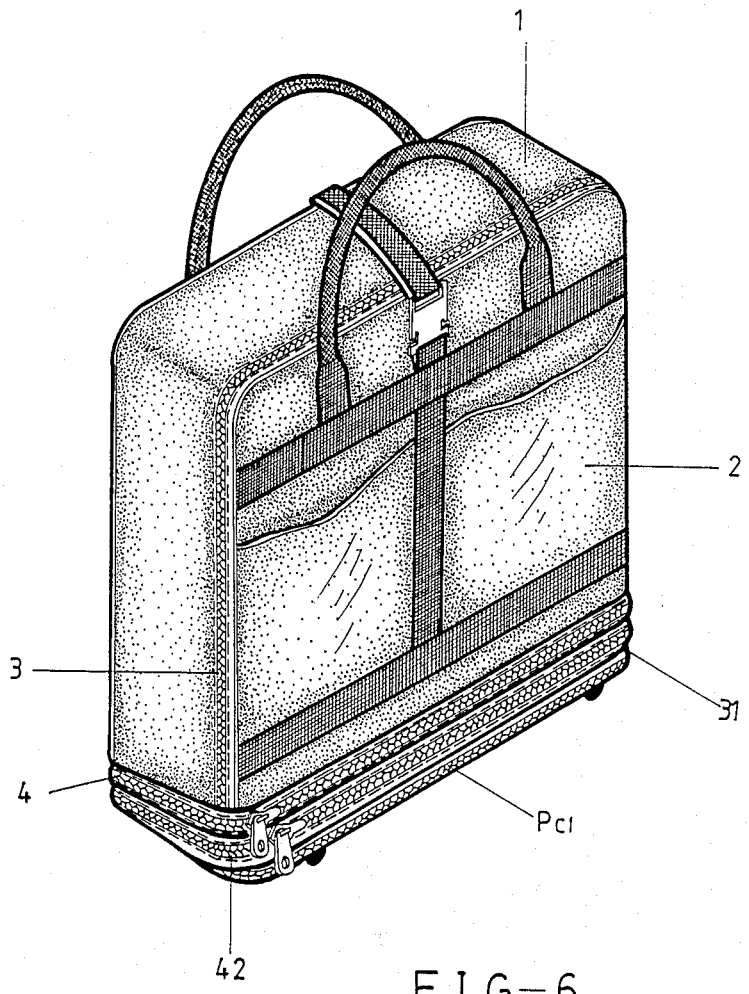
FIG. 6 is a perspective view of the case of FIG. 3, wherein the gussets are collapsed when the case is reduced in size.
Figure 7:
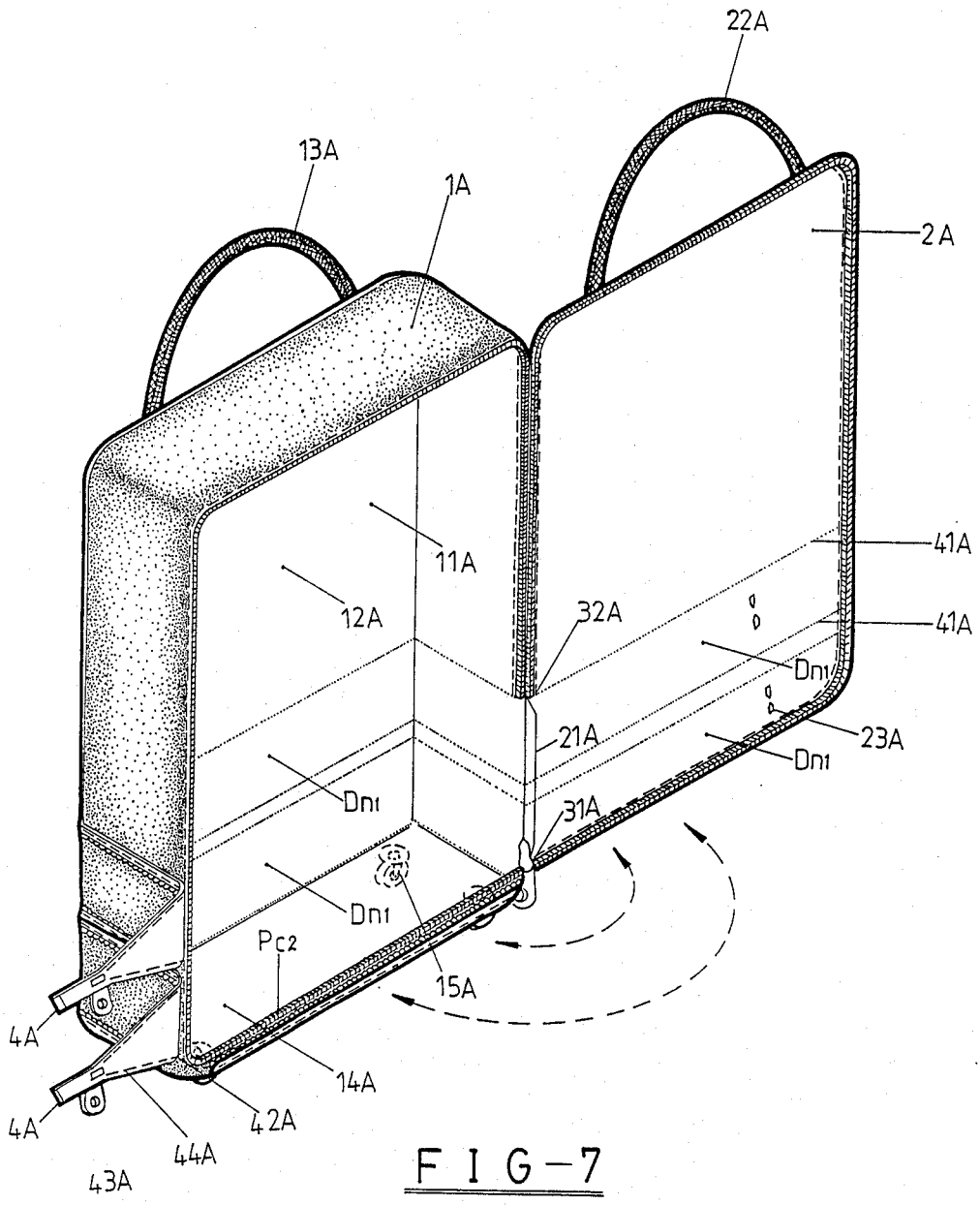
FIG. 7 is a perspective view of a second embodiment of the soft luggage case of the present invention, wherein the lid thereof is pivoted outwardly substantially 180 degrees from the remainder of the case to completely reveal the interior storage space thereof.
Figure 9:
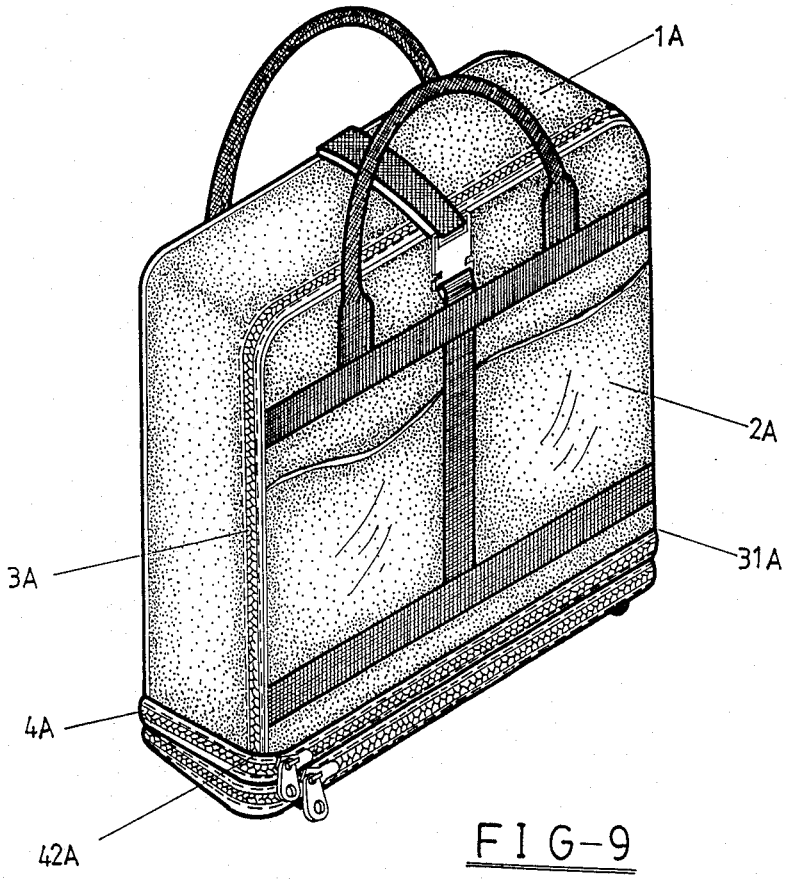
FIG. 9 is a perspective view of the case of FIG. 7, wherein the gussets are collapsed when the case is reduced in size.

As mentioned above, the assembly views of this invention are as shown in FIG. 4 and FIG. 8. When using the luggage case, the male and female fasteners of zipper head end of surrounding body zipper are unfastened for pulling or lifting the lid, so that the interior storage space can be used for storing things. Owing to the part of the lid and body which are still stitched together, the lid will not fall down, permitting things to be placed into the interior storage space (or removed therefrom). Again, owing to the lid being able to open or close, no matter the size of the articles, they can still be placed in or removed from the storage space (during things are removed, it is no need to turn over things in the case). At the suitable place of lower area of luggage case of this invention, there is one set, or more than one set, of assembly means fasteners and associated gussets. The volume of the box can be adjusted by connecting these fasteners. Owing to box being made of soft water-proofing material, the box portion between upper and lower zipper teeth of surrounding body zipper can be folded inwardly. When the fasteners of the fastener assembly means is closed, each gusset will be collapsed and volume of the case will be made smaller. However, during use of the case, attention should be paid that the access opening zipper means should be closed before the assembly means fasteners are closed. The assembly views of pulling-together surrounding body zipper are as shown in FIG. 6 and FIG. 9. Regarding the starting portion of access opening zipper means, it is sometimes exposed to outside (FIG. 6), but other times is folded inside the case (FIG. 9). The male and female connector elements can also be folded into the case, and the lid can still be opened or closed freely, as desired.

I claim:

1. An adjustable size luggage case comprising:

a substantially rectangular body having end walls, side walls, a top wall extending between the end walls and further extending between the side walls, a lower periphery being defined extending about the saide walls and end walls opposite of the top wall, the said side walls, end walls and top wall defining an interior storage space therebetween;

at least one gusset secured to and extending around the lower periphery, such that a lowermost gusset is provided, each of said gussets having respective side walls and end walls, an upper periphery and a lower, opposite periphery and each of said respective gussets further having a first collapsed position, wherein the gussets further having a first collapsed position, wherein the gusset is closed and a second expanded position, wherein the gusset is opened;

a bottom wall extending between the end walls of the lowermost gusset and further extending between the side walls of the lowermost gusset;

at least the top wall, the bottom wall and at least one of the side walls of the body and the gusset having a single continuous access opening formed therein, so that at least one of the end walls may be pivoted outwardly from the remainder of the body, whereby access to the interior storage space is provided;

an access opening zipper means formed about the access opening for selective opening and closing of the access opening;

a fastener assembly means positioned on each of said gussets, each of said fastener assembly means having a respective slider and a pair of fastener elements including a base end and a distal end;

one of the pair of each fastener elements connected to the upper periphery of each gusset;

the other of the pair of each fastener elements connected to the lower opposite periphery of each gusset;

a bridging flap positioned on each of said gussets, said bridging flap having one end integral with one of the side walls of the said gusset and further having a second opposite end;

a male connector element secured to each respective slider;

a female connector element secured to another of the said end walls of the gusset being separated from the said one of the side walls of the gusset by the access opening to removably receive and secure therein the male connector element, whereby the male and female connector elements are removably secured to each other;

the base end of each of the fastener elements positioned on a respective bridging flap and the distal end of each of the fastener elements disposed on the said another of said end walls of the gussets, said distal ends extending beyond the female connector;

wherein the movement of the slider along the fastener elements selectively fastens the pair of fastener elements of each respective fastener assembly means to the other fastener element of the same pair, moving the gusset into its first collapsed position and further selectively unfastens the one of fastener elements of each respective fastener assembly means from the other fastener element of the same pair, moving the gusset into its second expanded position; and further wherein, when the male and female connector elements are connected to one another, the bridging flap extends over the access opening, and the second opposite end of the flap is removably secured to the other of said end walls of the respective gusset.

2. The luggage case of claim 1, wherein the access opening formed on the lowermost gusset is formed between the upper periphery of said gusset and the other of the pair of fastener elements connected to the lower opposite periphery of said gusset.

3. The luggage case of claim 1, wherein the access opening formed on the lowermost gusset is formed between the lower periphery of said gusset and the other of the pair of fastener elements.

4. The luggage case of claim 1, wherein the fastener assembly means comprises a slider and a pair of fastener teeth; elements including a base end and a distal end, wherein sliding movement of the slider between the base and distal ends, selectively meshes or unmeshes the fastener teeth elements.

5. The device of claim 1 further including a plurality of casters secured externally to the bottom wall.

6. The device of claim 1, wherein the one of the end walls may be pivoted outwardly substantially at least 180 degrees from the remainder of the body.

* * * * *